US007517265B2

(12) United States Patent
Takahashi et al.

(10) Patent No.: US 7,517,265 B2
(45) Date of Patent: Apr. 14, 2009

(54) OUTBOARD MOTOR

(75) Inventors: Masanori Takahashi, Shizuoka-ken (JP); Noriyoshi Hiraoka, Shizuoka-ken (JP); Mitsuru Nagashima, Shizuoka-ken (JP); Yu Ito, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 25 days.

(21) Appl. No.: 11/756,535

(22) Filed: May 31, 2007

(65) Prior Publication Data

US 2008/0003896 A1 Jan. 3, 2008

(30) Foreign Application Priority Data

Jun. 16, 2006 (JP) ..... 2006-167946

(51) Int. Cl.
*B63H 21/36* (2006.01)

(52) U.S. Cl. ..... 440/77; 440/88 A

(58) Field of Classification Search ..... 440/77, 440/88 A, 84; 123/184.34, 184.37, 184.42, 123/198 E
See application file for complete search history.

(56) References Cited

U.S. PATENT DOCUMENTS 6,675,756 B2 * 1/2004 Katayama ..... 123/184.34
7,056,171 B2 * 6/2006 Matsuda ..... 440/88 A

FOREIGN PATENT DOCUMENTS

JP 11-034984 2/1999
JP 2002-114192 4/2002

* cited by examiner

*Primary Examiner*—Lars A Olson
(74) *Attorney, Agent, or Firm*—Knobbe, Martens, Olson & Bear, LLP.

(57) ABSTRACT

An outboard motor has an engine, a cowling for accommodating the engine, and an air duct for introducing ambient air into the cowling 11. An air filter is provided in the air duct. One or more sensors detect when the air filter is clogged. When air filter clogging is detected, a warning signal is triggered.

22 Claims, 6 Drawing Sheets

[FIG. 1]
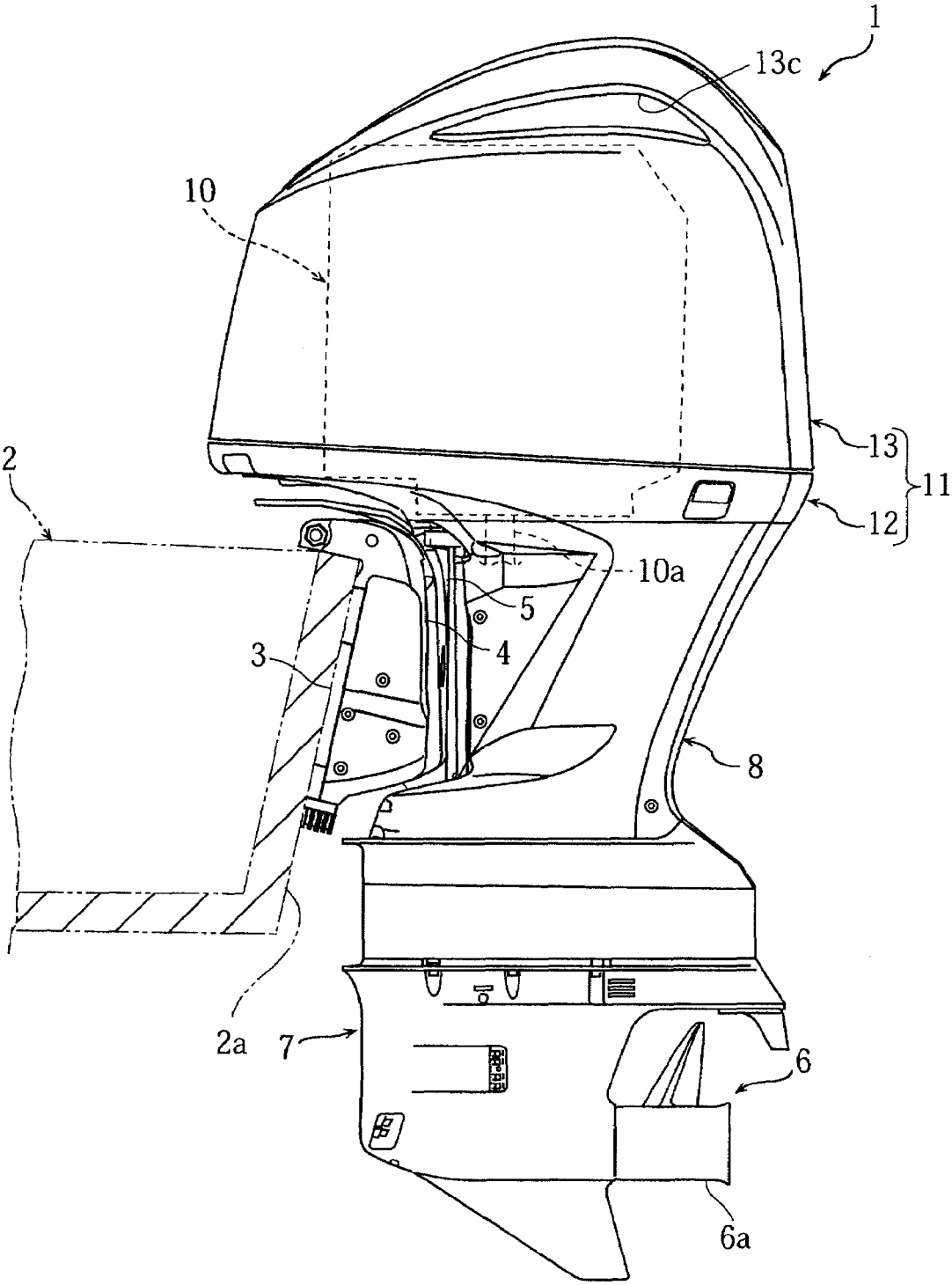

[FIG. 2]
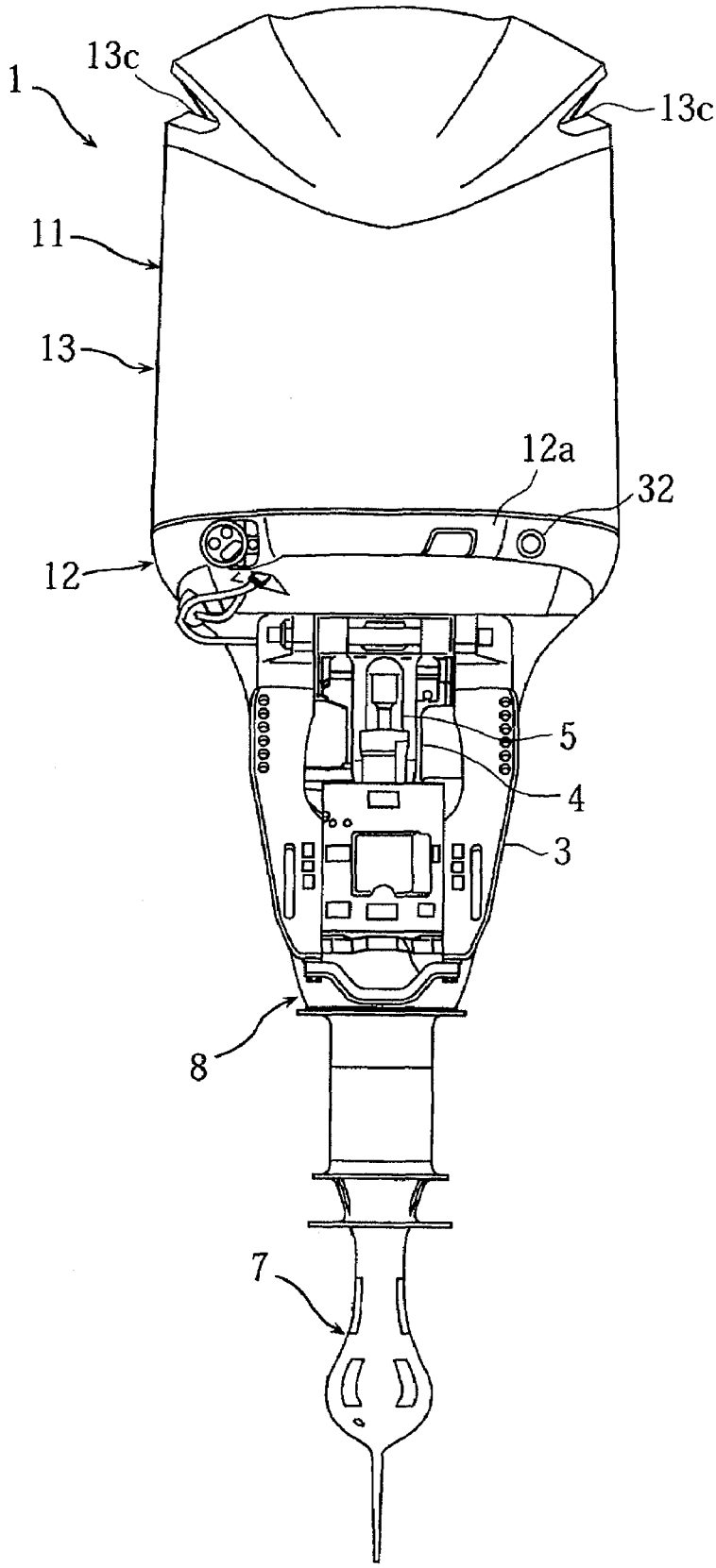

[FIG. 3]
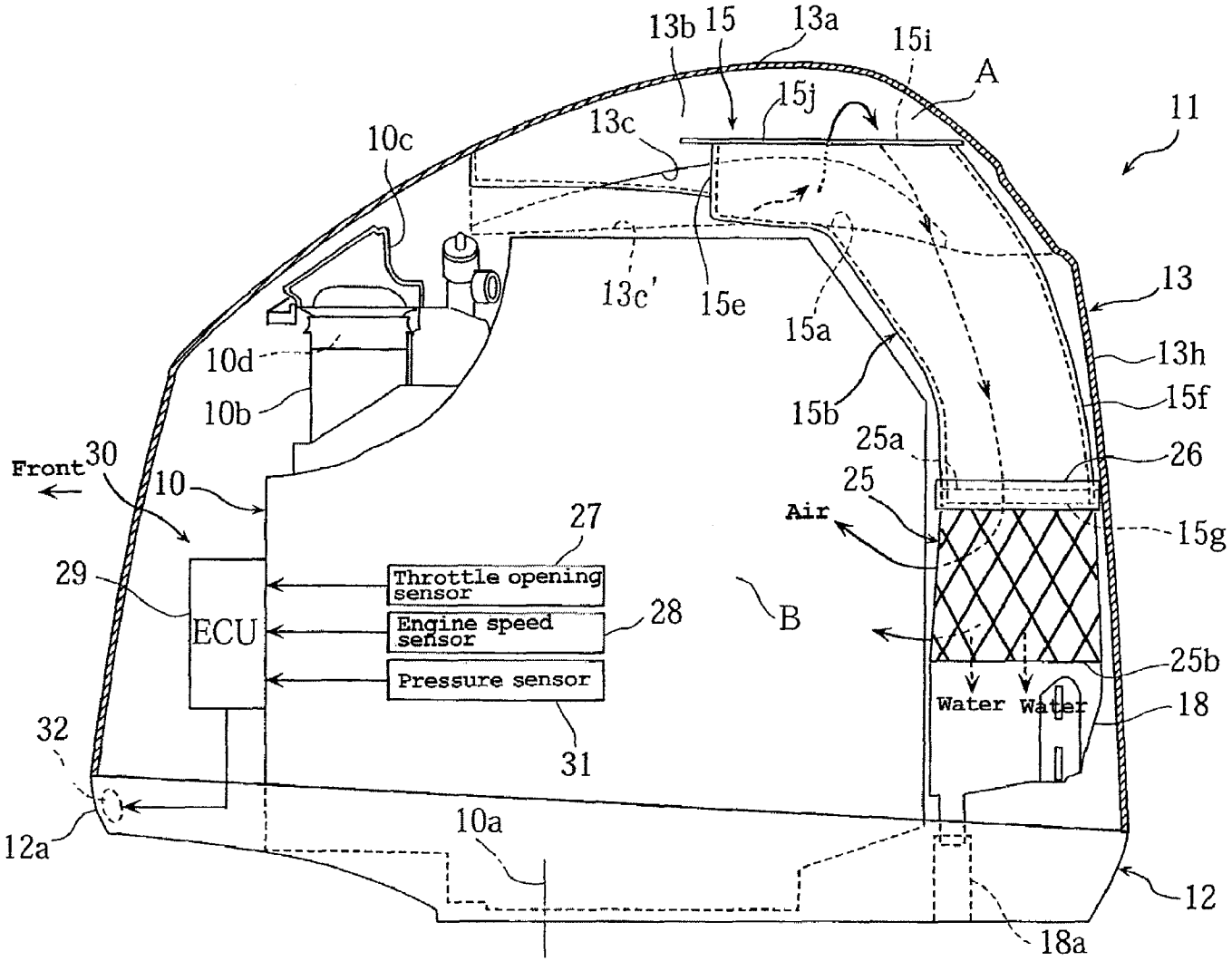

[FIG. 4]
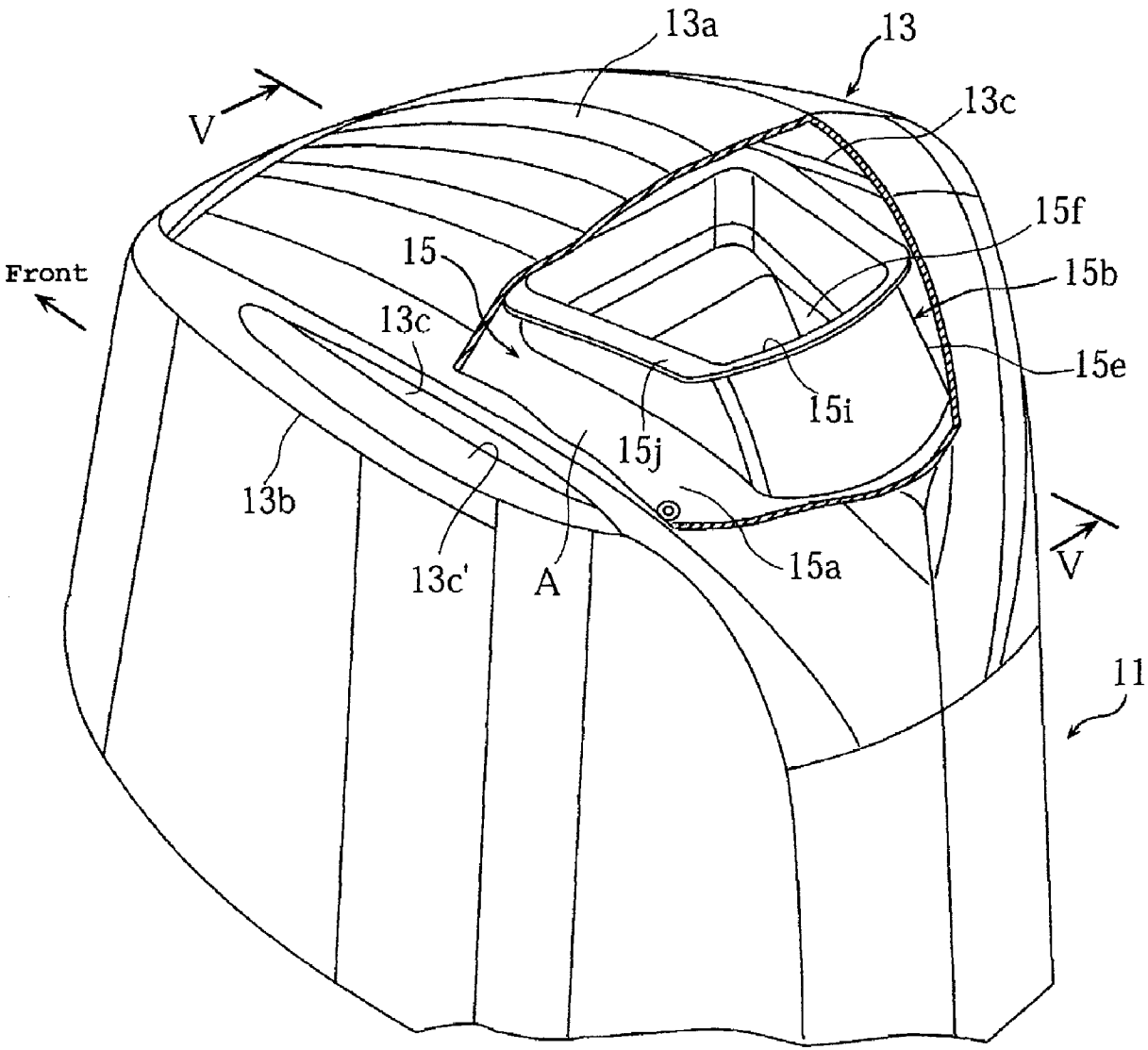

[FIG. 5]
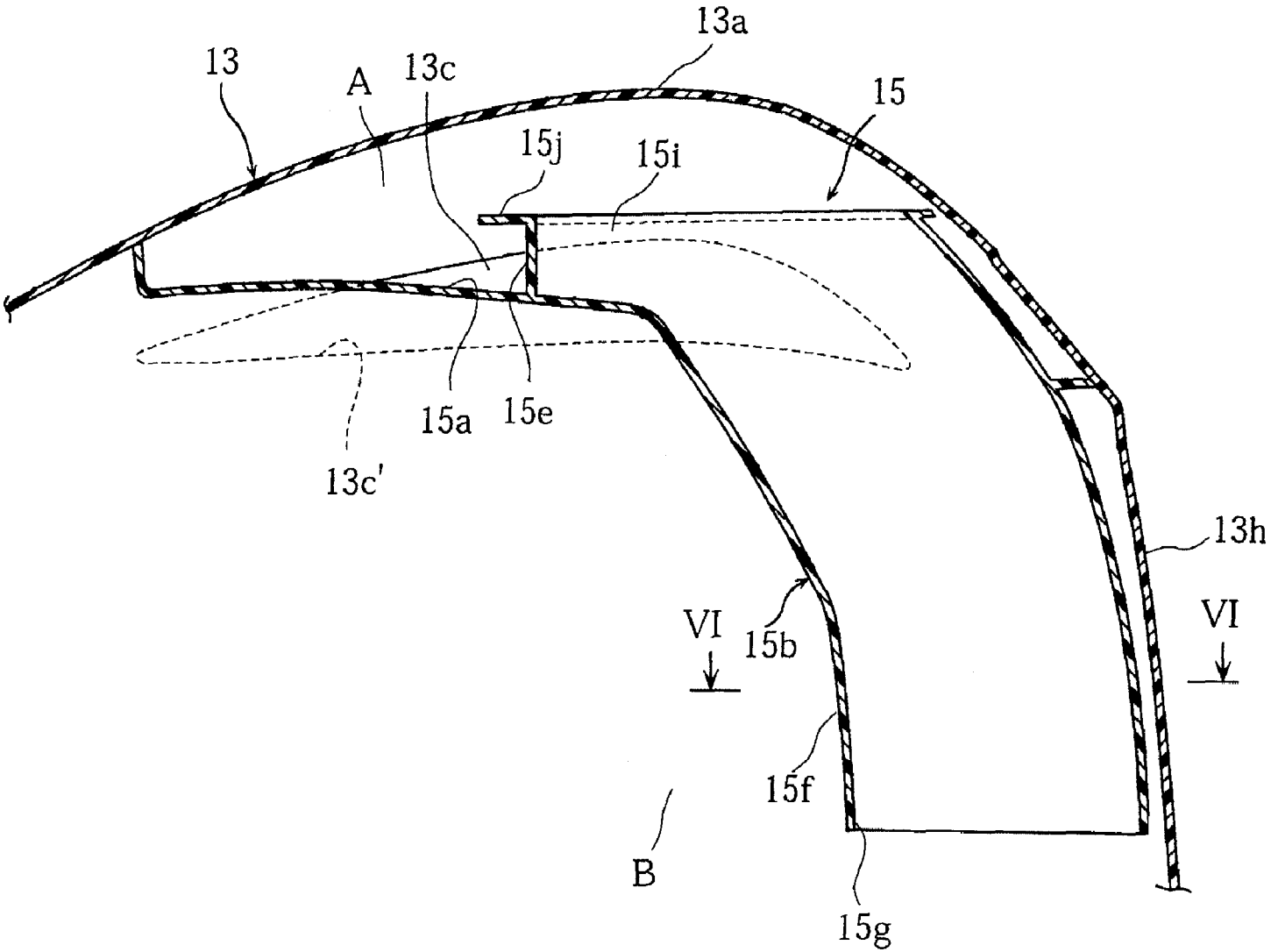

[FIG. 6]
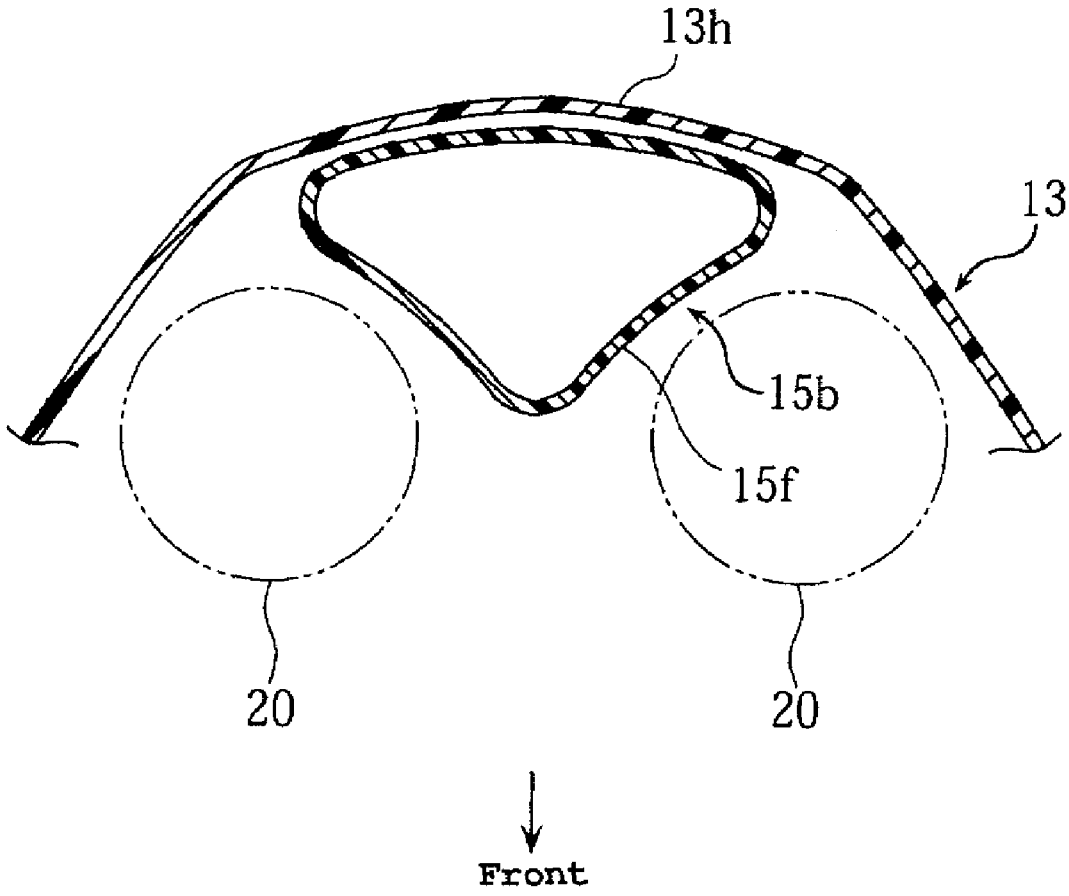

OUTBOARD MOTOR

CROSS-REFERENCE TO RELATED APPLICATIONS

The present application is based on and claims priority under 35 U.S.C. §119 to Japanese Patent Application Serial No. 2006-167946, filed on Jun. 16, 2006, the entire contents of which are expressly incorporated by reference herein.

BACKGROUND

1. Field of the Invention

This invention relates to an outboard motor provided with a cowling for accommodating an engine and an air duct for introducing ambient air into the cowling.

2. Description of the Related Art

Outboard motors typically are mounted at the stern of the boat. This positioning subjects the outboard motor to water splashes and the like during operation of the boat. Simultaneously, a cowling of an outboard motor must allow air to flow into the cowling to provide intake air for the engine. Accordingly most outboard motor cowlings have a water separation structure that separates water from the air inducted into the cowling and supplies the air to the engine.

For instance, Japanese Patent Publication No. 11-034984 teaches an outboard motor in which the space inside the cowling is divided into an air inlet chamber located above the engine and an engine accommodating chamber. An air duct is provided for guiding the air inducted into the air inlet chamber toward the engine accommodating chamber. In this structure, a swirling air flow circling around the outer face of the air duct is generated in the air inducted from the air inlet openings, thus separating water from the air.

During reverse operation, or at hard acceleration or deceleration, rising waves often splash onto such outboard motors. Water from such waves can sometimes enter the cowling and make its way into the engine accommodating chamber by way of the air duct.

SUMMARY

Accordingly, there is a need for an outboard motor that allows intake air to enter the cowling, but minimizes or eliminates water from the intake air.

Some surface boats have a generally hermetically-sealed hull in which an engine is mounted and also have a water-repellant filter in the intake passage to block water from entering the engine. However, due to their structure, is not likely for the filter provided on the surface boats to get clogged. Thus, surface boats have only a low possibility of having water enter directly into the intake passage of the engine. On the contrary, water can relatively easily enter into the air duct of an outboard motor. If a water-repellent filter is provided in the air duct of the outboard motor, it can prevent the water intrusion into the engine accommodating chamber, but the filter may be clogged frequently, possibly resulting in deterioration of engine output power in certain cases.

In addition, if the water-repellent filter is clogged by saline matter in seawater, dust, or other foreign matters, the negative pressure within the cowling will increase in magnitude due to the additional air intake resistance, thus possibly resulting in water intrusion through tiny gaps in the cowling that remain sealed during normal operation. Other problems such as insufficient engine output power may result due to the additional air intake resistance, which will impair the air intake efficiency. Thus, it is not practicable to apply the water-repellent filter used on the above-mentioned surface boat to the outboard motors.

Accordingly, there is a need for an outboard motor that can prevent water intrusion into the engine accommodating chamber, while avoiding deterioration of the engine output power caused by the clogging of a water filter.

In one embodiment, an outboard motor is provided having a cowling with an air intake duct having a filter that prevents water from flowing therethrough. The outboard motor is provided with a clogging detection means for detecting when the filter is clogged, and with notification means for notifying the operator when a clogged filter is detected. Thus, the problems of water intrusion into the cowling and/or deteriorated output power of the engine caused by the increased air intake resistance can be eliminated by cleaning or replacing the air filter according to such notification.

In accordance with one embodiment, the present invention provides an outboard motor comprising an engine, a cowling for accommodating the engine, an air duct for introducing ambient air into the cowling, a filter provided in the air duct, a clogging detection means for detecting clogging of the filter, and a notification means for signaling that the filter is clogged. The notification means is triggered when the clogging detection means determines that the filter is clogged.

In one embodiment, the filter comprises an air filter, and the air filter has a water-repellent property. In another embodiment, the engine has an air intake, and the filter is arranged vertically lower than the engine air intake. In yet another embodiment, a space within the cowling is divided into an air inlet chamber and an engine accommodation chamber. The air inlet chamber has a water separation structure. The air duct protrudes into the air inlet chamber and communicates the air inlet chamber with the engine accommodating chamber. The air filter is disposed on the air duct at its engine accommodating chamber side.

In a further embodiment, the cowling comprises a bottom cowling and a top cowling detachably mounted to the bottom cowling, and the air filter is disposed so that it is exposed to ambient air when the top cowling is removed from the bottom cowling.

In another embodiment, the clogging detection means comprises a sensor. In one such embodiment, the clogging detection means comprises a pressure sensor adapted to detect the pressure within the cowling. The clogging detection means is configured to determine the filter is clogged when the pressure detected by the pressure sensor falls below a predetermined negative pressure.

In yet another embodiment, the clogging detection means comprises a plurality of sensors, and the clogging detection means is configured to determine that the filter is clogged when the readings of at least two of the sensors satisfy a predetermined relationship. In one such embodiment, the clogging detection means comprises an engine speed sensor for detecting the engine revolutions per minute, and a throttle opening sensor. The clogging detection means is configured to detect clogging when the engine speed sensor detects a speed that is below a predetermined engine revolutions per minute value corresponding to a given throttle opening.

In accordance with another embodiment, the present invention provides an outboard motor comprising an engine, a cowling for accommodating the engine, an air duct for introducing ambient air into the cowling, a filter provided in the air duct, a sensor for detecting a condition of the outboard motor, and an electronic control unit (ECU) communicating with the sensor and adapted to analyze the sensor readings.

The ECU is configured so that when the sensor readings are within predetermined parameters, the ECU determines that the filter is clogged.

In one such embodiment, the sensor comprises a pressure sensor for detecting the pressure within the cowling. The ECU is configured so that when the pressure sensor detects a pressure less than a predetermined negative pressure, the ECU determines that the filter is clogged.

Another embodiment additionally comprises a second sensor for detecting a condition of the outboard motor. The second sensor communicates with the ECU. The ECU is configured so that when the respective sensor readings are within a predetermined relationship with each other, the ECU determines that the filter is clogged.

In one such embodiment, the sensors comprise an engine speed sensor and a throttle opening sensor. When the ECU is configured so that when the detected engine speed is less than a predetermined value corresponding to a give throttle opening, the ECU determines that the filter is clogged. In another embodiment, the filter comprises an air filter and the engine comprises an air intake. The air filter is disposed vertically lower than the engine air intake.

BRIEF DESCRIPTION OF THE DRAWINGS

FIG. 1 is a side view of an outboard motor according to an embodiment of the present invention, mounted to the stern of a boat.

FIG. 2 is a front view of the outboard motor.

FIG. 3 is a side view of an engine accommodated in a cowling of the outboard motor.

FIG. 4 is a perspective, partially cut away view of the cowling.

FIG. 5 is a cross sectional view of a portion of the cowling (cross sectional view along the line V-V in FIG. 4).

FIG. 6 is a cross sectional view of a portion of the cowling (cross sectional view along the line VI-VI in FIG. 5).

DETAILED DESCRIPTION OF PREFERRED EMBODIMENTS

FIGS. 1 through 6 illustrate an outboard motor according to an embodiment of the present invention.

FIG. 1 is a side view of the outboard. FIG. 2 is a front view of the outboard motor. FIG. 3 is a sectional side view of a cowling accommodating an engine. FIG. 4 is a perspective view of the cowling. FIG. 5 is a cross sectional view of an air duct (cross sectional view along the line V-V in FIG. 4). FIG. 6 is a cross sectional view of an air duct (cross sectional view along the line VI-VI in FIG. 5). Note that the terms "right," "left," "front" and "rear" mean right, left, front and rear sides which are defined as viewed from the bow of a boat.

In the figures, the numeral 1 refers to the outboard motor mounted at a stern 2*a* of a boat body 2. The outboard motor 1 preferably is supported by a clamp bracket 3 fastened to the stern 2*a*, in a vertically swingable manner by means of a swivel arm 4, and in a steerable manner to both sides by means of a pivot shaft 5.

The illustrated outboard motor 1 has a general structure in which an upper case 8 is joined to the top face of a lower case 7, which accommodates a propulsion unit 6 including a propeller 6*a*. An engine 10 is installed on the upper face of the upper case 8. A cowling 11 preferably is mounted to enclose the outer periphery of the engine 10.

The engine 10 preferably is disposed vertically so that a crankshaft 10*a* is kept generally vertical during boat operation. The thrust is generated by rotationally driving the propeller 6*a* of the propulsion unit 6 by the crankshaft 10*a*.

A throttle body 10*b* preferably is disposed at the upper front end of the engine 10, and is joined in communication with an intake port (not shown). A silencer 10*c* is installed at an air inlet 10*d* of the throttle body 10*b*.

The cowling 11 preferably includes a bottom cowling 12 for covering the bottom of the engine 10, and a top cowling 13 for covering the upper part of the engine 10. The engine 10 is exposed to the ambient air when the top cowling 13 is removed, allowing access for maintenance of the engine 10.

A molding 15 preferably is provided in the cowling 11 to divide the space inside the cowling 11 into an air inlet chamber (A) having a water separation structure, and an engine accommodating chamber (B).

In the illustrated embodiment, the molding 15 is disposed above the engine 10 in the top cowling 13. The space enclosed by the upper surface of the molding 15 and a top wall 13*a* of the top cowling 13 defines the air inlet chamber (A), while the space below the molding 15 defines the engine accommodating chamber (B).

Air inlet openings 13*c*, 13*c*, each having a shape resembling a propeller blade section in the side view, are formed on the left and the right walls 13*b*, 13*b* on both sides of the top cowling 13 in the transverse direction of the boat. Each of the left and the right air inlet openings 13*c* is disposed at the upper end of the top cowling 13 to communicate with the air inlet chamber (A).

The molding 15 is attached inside the top wall 13*a* of the top cowling 13, providing a bulkhead 15*a* descending toward the left and the right air inlet openings 13*c*, and an air duct 15*b* is integrated in the bulkhead 15*a* for inducing the air to the engine accommodating chamber (B) after the air is introduced into the air inlet chamber (A). The bulkhead 15*a* preferably forms a continuous surface with a lower edge 13*c*' of the air inlet opening 13*c*.

The air duct 15*b* preferably has an upper duct section 15*e* protruding into the air inlet chamber (A) from the bulkhead 15*a*, and a lower duct section 15*f* extending continuously from the rear part of the upper duct section 15*e* into the engine accommodating chamber (B) from the bulkhead 15*a* in the protruding manner.

An intake opening 15*i* of the upper duct section 15*e* opposes the top wall 13*a* of the top cowling 13 with a predetermined gap between them. In the illustrated embodiment, a flange portion 15*j* is formed at the intake opening 15*i* to extend toward the left and the right air inlet openings 13*c*. Other embodiments have a flange circumferentially surrounding the opening 15*i*. Still further embodiments have no such flange.

As described in the sections above, the upper duct section 15*e* protrudes into the air inlet chamber (A), and the flange portion 15*j* is formed at the intake opening 15*i* opposing the top wall 13*a* at the predetermined distance. These features constitute a water separation structure that separates water from the air inducted into the air inlet chamber (A) by preferably directing the air to swirl around the outer face of the upper duct section 15*e*.

The lower duct section 15*f* preferably extends downward along a rear wall 13*h* of the top cowling at the back of the engine 10. A discharge outlet 15*g* opening at the bottom end of the lower duct section 15*f* is positioned in the midway of the vertical dimension of the engine 10. Arranged in this way, the discharge outlet 15*g* is positioned lower than an air intake 10*d* of the throttle body 10*b*.

As illustrated in the cross-sectional top view of FIG. 6, the lower duct section 15*f* preferably has an approximately triangle shape with its vertex angle being positioned between the left and the right exhaust pipes 20, 20. Such an arrangement avoids interference of the lower duct section 15*f* with the exhaust pipes 20.

A generally pail-shaped water collecting part 18 preferably is provided inside the cowling 11 below the discharge outlet 15*g* of the lower duct section 15*f*. The water collecting part 18 can open to the atmosphere through the underside of the bottom cowling 12. This arrangement allows water that may enter into the air duct 15*b* to drip from the discharge outlet 15*g* and to gather in the water collecting part 18. The collected water can be discharged to the atmosphere from the bottom cowling 12 through a water discharge passage 18*a*.

As shown in FIG. 3, a generally cylindrical, water-repellent air filter 25 is preferably disposed between the discharge outlet 15*g* of the lower duct section 15*f* and the water collecting part 18.

The water-repellent air filter 25 preferably is a non-woven fabric or paper filter preferably made of polypropylene and treated with water-repellent finish. This allows only air to pass through the filter into the engine accommodating chamber (B), while water droplets, saline matter, dust, and other foreign matter is dropped into the water collecting part 18.

An upper end opening 25*a* of the air filter 25 preferably is installed detachably to the lower duct section 15*f* by means of a belt member 26, and the lower end opening 25*b* of the air filter 25 is inserted detachably into the water collecting part 18. Of course, other modes of mounting the filter are contemplated.

The air filter 25 preferably is positioned lower than an air intake 10*d* of the engine 10. In addition, the air filter 25 is arranged to be exposed to the ambient air along with the engine 10, when the top cowling is removed.

As the air is introduced into the air inlet chamber (A) from the air inlet openings 13*c* provided on both sides of the top cowling 13, the swirling flow is generated in the air by the water separation structure described above. The swirling flow circles around the outer face of the upper duct section 15*e* and the flange portion 15*j* within the air inlet chamber (A). Water is separated from the air through this process, and the separated water flows down on the bulkhead 15*a* of the molding 15 to be drained onto the outer wall surface of the top cowling 13 through the air inlet opening 13*c*.

After the initial separation of water, the air is induced into the upper duct section 15*e*, flows through the lower duct section 15*f*, passes through the water-repellent air filter 25, flows into the engine accommodating chamber (B), and ascends in the engine accommodating chamber (B) to be drawn into the engine 10. Water, saline matter, dust, and other foreign matter that made it past the water separation structure are blocked by the air filter 25 and collected in the water collecting part 18.

The outboard motor 1 preferably has an engine operation control unit for controlling the operation of the engine 10. The engine operation control unit includes a throttle opening sensor 27 for detecting the position of the throttle valve in the throttle body 10*b*, an engine speed sensor 28 for detecting the engine revolutions per minute, a pressure sensor 31 for detecting the pressure in the engine accommodating chamber (B), and an ECU 29 for receiving the detection signals transmitted by each sensor 27, 28, and 31. The ECU 29 is configured to control the amount of fuel delivery, fuel delivery timing, and ignition timing, for instance, in accordance with the detection signals transmitted by the sensors 27, 28.

In addition, the outboard motor 1 preferably has a clogging warning device 30 for notifying the clogging of the air filter 25. In one embodiment, the clogging warning device 30 includes the pressure sensor 31, which can detect clogging of the air filter 25, the engine speed sensor 28, and the ECU 29, which can trigger a notification that the filter is clogged by activating a warning lamp 32, buzzer, or the like.

The warning lamp 32 preferably is disposed on one side of a front wall 12*a* of the bottom cowling 12 in the transverse direction of the boat (See FIGS. 2 and 3). In another embodiment, the warning lamp 32 may be provided at the driver's seat on the boat 2.

In one embodiment, the ECU 29 is configured to transmit the warning signal to the warning lamp 32 when the value of the pressure detected by the pressure sensor 31 falls to or below a predetermined negative pressure level, or when the engine rpm detected by the engine speed sensor 28 falls to or below an engine rpm level predetermined correspondingly to the given throttle opening.

In another embodiment, the ECU 29 may be configured to transmit the warning signal when the value of the pressure detected by the pressure sensor 31 falls to or below the predetermined negative pressure, and at the same time the value detected by the engine speed sensor 28 falls to or below the predetermined engine speed.

According to one preferred embodiment, the pressure sensor 31 and the engine speed sensor 28 are provided to detect the clogging of the water-repellent air filter 25 attached to the lower duct section 15*f* of the molding 15, and the ECU 29 is provided for analyzing sensor readings and activating the warning lamp 32, or other signal, when clogging is detected at the air filter 25. Therefore, the driver can become aware of clogging of the air filter 25 by the activated warning lamp 32. Problems due to the increased air intake resistance and/or deterioration of the output power from the engine 10 due to a clogged air filter 25 can be eliminated by cleaning or replacing the air filter 25 once the warning lamp 32 is activated.

According to one preferred embodiment, the warning lamp 32 is activated when the pressure inside the cowling 11 detected by the pressure sensor 31 falls to or below the predetermined negative pressure. Thus, the negative pressure inside the cowling 11 that may be caused by the clogged air filter 25 can be quickly and easily detected and cured, and water intrusion through gaps on the cowling 11 is prevented.

According to one preferred embodiment, the warning lamp 32 is activated when the engine speed detected by the engine speed sensor 28 falls to or below the engine speed predetermined corresponding to the throttle opening. Thus, deterioration of the engine output power due to the clogged air filter 25 is detected quickly and easily so that it may be quickly cured by air filter maintenance.

In addition, the engine speed sensor 28 and the ECU 29 described above preferably are existing components on the outboard motor used for the operation control of the engine 10. Thus, no additional sensor is required, to detect air filter clogging resulting in the elimination of additional cost. For example, in such an embodiment, the outboard motor would not necessarily include a cowling internal pressure sensor.

In a preferred embodiment, the cowling 11, which includes the bottom cowling 12 for covering the bottom of the engine 10 and a top cowling 13 mounted detachably to the bottom cowling 12 for covering the upper part of the engine 10, is configured with the warning lamp 32 disposed on the front wall 12*a* of the bottom cowling 12. Thus, the boat operator can recognize the warning lamp 32 easily. Mounting and dismounting of the top cowing 13 can be performed easily as well. For comparison, if the warning lamp 32 is provided on the top cowling, wiring to the warning lamp may need to be disconnected every time the top cowling 13 is removed.

In a preferred embodiment, the engine 10 and the air filter 25 are exposed to the ambient air when the top cowling 13 is removed. Thus, the maintenance work on the engine and the air filter 25 can be performed easily.

Also, the air filter 25 preferably is positioned lower than an air intake 10*d* of the engine 10. This provides another level of separation of water from the air and the air must rise to the intake 10*d*.

Embodiments discussed herein use both the pressure sensor 31 and the engine speed sensor 28 as to detect a clogged air filter. However, the present invention is not limited to such arrangement, and in other embodiments the clogged air filter may be detected by either of the sensors, or similar sensors, taken alone.

Further, in an embodiment described above, the air duct 15*b* has the lower duct section 15*f* extending downward to protrude into the engine accommodating chamber (B), however, the air duct of the present invention does not have to be protruding downward as illustrated. Preferably, however, the air inlet chamber and the engine accommodating chamber are communicated by on air duct.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor, comprising an engine, a cowling for accommodating the engine, an air duct for introducing ambient air into the cowling, the air duct having an outlet end, a filter disposed downstream from the outlet end of the air duct, a clogging detection means for detecting clogging of the filter, a notification means for signaling that the filter is clogged, the notification means being triggered when the clogging detection means determines that the filter is clogged, and a water collecting part positioned below the outlet end of the air duct, the filter being positioned between the water collecting part and the outlet end of the air duct.

2. An outboard motor as in claim 1, wherein the filter comprises an air filter, and the air filter is cylindrical and has a water-repellent property.

3. An outboard motor as in claim 2, wherein the engine has an air intake, and the filter is arranged vertically lower than the engine air intake.

4. An outboard motor as in claim 2, wherein a space within the cowling is divided into an air inlet chamber and an engine accommodation chamber, the air inlet chamber having a water separation structure, the air duct protruding into the air inlet chamber and communicating the air inlet chamber with the engine accommodating chamber, and the air filter is disposed on the air duct at its engine accommodating chamber side.

5. An outboard motor as in claim 4, wherein the cowling comprises a bottom cowling and a top cowling detachably mounted to the bottom cowling, and the air filter is disposed so that it is exposed to ambient air when the top cowling is removed from the bottom cowling.

6. An outboard motor as in claim 1, wherein the clogging detection means comprises a sensor.

7. An outboard motor as in claim 6, wherein the clogging detection means comprises a pressure sensor adapted to detect the pressure within the cowling, and the clogging detection means is configured to determine the filter is clogged when the pressure detected by the pressure sensor falls below a predetermined negative pressure.

8. An outboard motor as in claim 6, wherein the clogging detection means comprises a plurality of sensors, and the clogging detection means is configured to determine that the filter is clogged when the readings of at least two of the sensors satisfy a predetermined relationship.

9. An outboard motor as in claim 1, wherein the water collecting part is disposed directly beneath the filter.

10. An outboard motor as in claim 1, wherein the water collecting part is generally pail shaped and arranged so as to collect water falling out of the filter.

11. An outboard motor, comprising an engine, a cowling for accommodating the engine, an air duct for introducing ambient air into the cowling, a filter provided in the air duct, a clogging detection means for detecting clogging of the filter, and a notification means for signaling that the filter is clogged, the notification means being triggered when the clogging detection means determines that the filter is clogged, wherein the clogging detection means comprises a plurality of sensors, and the clogging detection means is configured to determine that the filter is clogged when the readings of at least two of the sensors satisfy a predetermined relationship, wherein the clogging detection means comprises a sensor, wherein the clogging detection means comprises an engine speed sensor for detecting the engine revolutions per minute, and a throttle opening sensor, wherein the clogging detection means is configured to detect clogging when the engine speed sensor detects a speed that is below a predetermined engine revolutions per minute value corresponding to a given throttle opening.

12. An outboard motor as in claim 11 wherein the cowling comprises a bottom cowling and a top cowling detachably mounted to the bottom cowling, and the notification means comprises a warning lamp, wherein the warning lamp is disposed on the bottom cowling.

13. An outboard motor comprising an engine, a cowling for accommodating the engine, an air duct for introducing ambient air into the cowling, the air duct having a discharge outlet within the cowling, a filter provided downstream from the discharge outlet, a sensor for detecting a condition of the outboard motor, an electronic control unit (ECU) communicating with the sensor and adapted to analyze the sensor readings, wherein the ECU is configured so that when the sensor readings are within predetermined parameters, the ECU determines that the filter is clogged, and a water collecting part disposed below the discharge outlet and arranged such that the filter is disposed between the discharge outlet and the water collecting part.

14. An outboard motor as in claim 13 wherein the sensor comprises a pressure sensor for detecting the pressure within the cowling, and wherein the ECU is configured so that when the pressure sensor detects a pressure less than a predetermined negative pressure, the ECU determines that the filter is clogged.

15. An outboard motor as in claim 13 additionally comprising a second sensor for detecting a condition of the outboard motor, the second sensor communicating with the ECU, wherein the ECU is configured so that when the respective sensor readings are within a predetermined relationship with each other, the ECU determines that the filter is clogged.

16. An outboard motor as in claim 13 additionally comprising a warning signal, wherein the ECU is configured to actuate the warning signal when the ECU determines that the filter is clogged.

17. An outboard motor as in claim 13 wherein the water collecting part is disposed directly beneath the filter.

18. An outboard motor as in claim 13 wherein the water collecting part is generally pail-shaped and arranged so as to collect water falling out of the filter.

19. An outboard motor comprising an engine, a cowling for accommodating the engine, an air duct for introducing ambient air into the cowling, a filter provided in the air duct, a sensor for detecting a condition of the outboard motor, an electronic control unit (ECU) communicating with the sensor and adapted to analyze the sensor readings, wherein the ECU is configured so that when the sensor readings are within predetermined parameters, the ECU determines that the filter is clogged, and a second sensor for detecting a condition of the outboard motor, the second sensor communicating with the ECU, wherein the ECU is configured so that when the respective sensor readings are within a predetermined relationship with each other, the ECU determines that the filter is clogged, wherein the sensors comprise an engine speed sensor and a throttle opening sensor, wherein when the ECU is configured so that when the detected engine speed is less than a predetermined value corresponding to a give throttle opening, the ECU determines that the filter is clogged.

20. An outboard motor as in claim 19 wherein the filter comprises an air filter and the engine comprises an air intake, and the air filter is disposed vertically lower than the engine air intake.

21. An outboard motor comprising an engine, a cowling for accommodating the engine, an air duct for introducing ambient air into the cowling, a filter provided in the air duct, a sensor for detecting a condition of the outboard motor, an electronic control unit (ECU) communicating with the sensor and adapted to analyze the sensor readings, wherein the ECU is configured so that when the sensor readings are within predetermined parameters, the ECU determines that the filter is clogged, and a warning signal, wherein the ECU is configured to actuate the warning signal when the ECU determines that the filter is clogged, wherein the warning signal comprises a lamp.

22. An outboard motor as in claim 21, wherein the cowling comprises a bottom cowl and a top cowl that is removably attached to the bottom cowl, and wherein the warning signal lamp is disposed on the bottom cowl.

* * * * *